US005265302A

United States Patent [19]

Sivacoe

[11] Patent Number: 5,265,302

[45] Date of Patent: * Nov. 30, 1993

[54] PIPELINE PIG

[76] Inventor: Orlande Sivacoe, #601, 4700 - 55 St., Red Deer, Alberta, Canada, T4N 2H8

[ * ] Notice: The portion of the term of this patent subsequent to Sep. 29, 2009 has been disclaimed.

[21] Appl. No.: 828,234

[22] Filed: Jan. 30, 1992

Related U.S. Application Data

[63] Continuation-in-part of Ser. No. 674,386, Mar. 25, 1991, Pat. No. 5,150,493.

[30] Foreign Application Priority Data

Mar. 12, 1991 [CA] Canada ..... 2038019

[51] Int. Cl.[5] ..... B08B 9/04

[52] U.S. Cl. ..... 15/104.061

[58] Field of Search ..... 15/104.061, 104.062, 15/104.063, 3.5, 3.51; 137/268

[56] References Cited

U.S. PATENT DOCUMENTS

| | | | |
|---|---|---|---|
| 2,953,800 | 9/1960 | Bowerman | 15/104.061 |
| 3,474,479 | 10/1969 | Girard | 15/104.061 |
| 3,530,523 | 9/1970 | Ver Nooy | 15/104.061 |
| 3,543,323 | 12/1970 | Girard | 15/104.061 |
| 3,602,934 | 9/1971 | Reed | 15/104.061 |
| 3,857,132 | 12/1974 | Knapp et al. | 15/104.061 |
| 3,879,790 | 4/1975 | Girard | 15/104.061 |
| 3,939,519 | 2/1976 | Muirhead | 15/104.061 |
| 4,016,620 | 4/1977 | Powers | 15/104.061 |
| 4,069,535 | 1/1978 | Cato | 15/104.061 |
| 4,077,079 | 3/1978 | Knapp | 15/104.061 |
| 4,081,875 | 4/1978 | Nishino | 15/104.061 |
| 4,242,771 | 1/1981 | Knapp | 15/104.061 |
| 4,244,073 | 1/1981 | Sagawa | 15/104.061 |
| 4,406,031 | 9/1983 | Eimer et al. | 15/104.061 |
| 4,825,498 | 5/1989 | Rankin . | |
| 4,876,761 | 10/1989 | Sagawa . | |
| 5,035,021 | 7/1991 | Le Devehat . | |

FOREIGN PATENT DOCUMENTS

| | | |
|---|---|---|
| 5779090 | 6/1990 | Austria . |
| 0234072 | 9/1987 | European Pat. Off. . |
| 278318 | 8/1970 | U.S.S.R. . |
| 714105 | 8/1954 | United Kingdom . |
| 844116 | 8/1960 | United Kingdom . |
| 2229247 | 3/1990 | United Kingdom . |

*Primary Examiner*—Edward L. Roberts
*Attorney, Agent, or Firm*—Gregg I. Anderson

[57] ABSTRACT

A pipeline pig has hollow flared ends and a central portion of smaller radial dimension than adjacent parts of the pig. Detachable appendages extend radially outward from the pig in circumferential rows. At least one row of appendages is in the central portion and the appendages extend radially outward less than the other rows of appendages. The appendages are threaded into sleeves having anchored bases. The row of appendages that extends radially outward by a smaller amount than the other appendages is subjected to reduced wear, but when the pig encounters resistance, the central part of the pig extends outward bringing the appendages into contact with the interior of the pipeline.

19 Claims, 4 Drawing Sheets

PIPELINE PIG

This application is a continuation-in-part of my co-pending application No. 07/674,386 filed Mar. 25, 1991, U.S. Pat. No. 5,150,493.

FIELD OF THE INVENTION

This invention relates to pipeline pigs, and to detachable appendages for such pigs.

BACKGROUND AND SUMMARY OF THE INVENTION

Pipeline pigs are used to remove coatings or scale from the inside of pipelines. This coating can vary in thickness and hardness. For example, deposits of coke can form soft coatings several millimeters thick, while hard scale such as iron sulphide may form coatings less than 1 mm thick. Pipeline pigs are forced through the pipelines under hydraulic pressure and the coating is removed by the scraping action of the pigs. To improve the scraping action, such pigs may include hard appendages that scrape the coating. These appendages are subject to wear, and can be expensive and inconvenient to replace.

In my co-pending application I disclose a pipeline pig having a generally cylindrical body made of elastic material by a moulding process, and a plurality of appendages disposed about and extending radially outward from the body. The appendages are secured to the body by being threaded into threaded sleeves that are inserted in the body during the moulding process, with plates extending laterally outward from the sleeves into the body to resist removal of the appendages from the body and to prevent the appendages from being driven into the body. By being threaded into the sleeves, the appendages may be readily detached from the pig body.

I have now designed an improvement to the pipeline pig disclosed in that application, in which the central portion of the body has a portion with reduced radius such that at least a first set of appendages extends radially outward less than a second set of appendages. Thus when the pig is in a pipeline and being moved along the pipeline by hydraulic pressure, the first set of appendages will not be worn as much as the second set of appendages and their lifetime will be extended. When a part of the pipeline is encountered which is coated with an unwanted deposit, the pig will find it harder to move through that part of the pipeline and hydraulic pressure will build up behind the pig, until the pig is forced through the coated part of the pipeline. The hydraulic pressure on the pig will cause the central portion of the pig to expand, bringing the first set of appendages against the pipeline and thus in position to scrape the coating from the interior of the pipeline.

To allow replacement of worn appendages, the appendages are also readily detachable. Preferably the appendages are secured in the body of the pig by being threaded in sleeves, with the sleeves having laterally extending flanges at their bases. The appendages may include a hardened tip for use in the case of hard scale. Washers may be used to extend the appendages outward as they wear.

For applications where little by-pass of the hydraulic fluid past the pig is desired, the ends of the pig are preferably flared and hollow so that hydraulic pressure on the pig will cause the flared ends to expand into sealing contact with the interior of the pipeline. The greater the resistance that the pig encounters, the greater will be the expansion of the flared end sections and the central portion of the pig.

BRIEF DESCRIPTION OF THE DRAWINGS

There will now be described a preferred embodiment of the invention, with reference to the drawings, by way of illustration, in which like numerals denote like elements and in which.

DETAILED DESCRIPTION OF PREFERRED EMBODIMENTS

Figure 1:
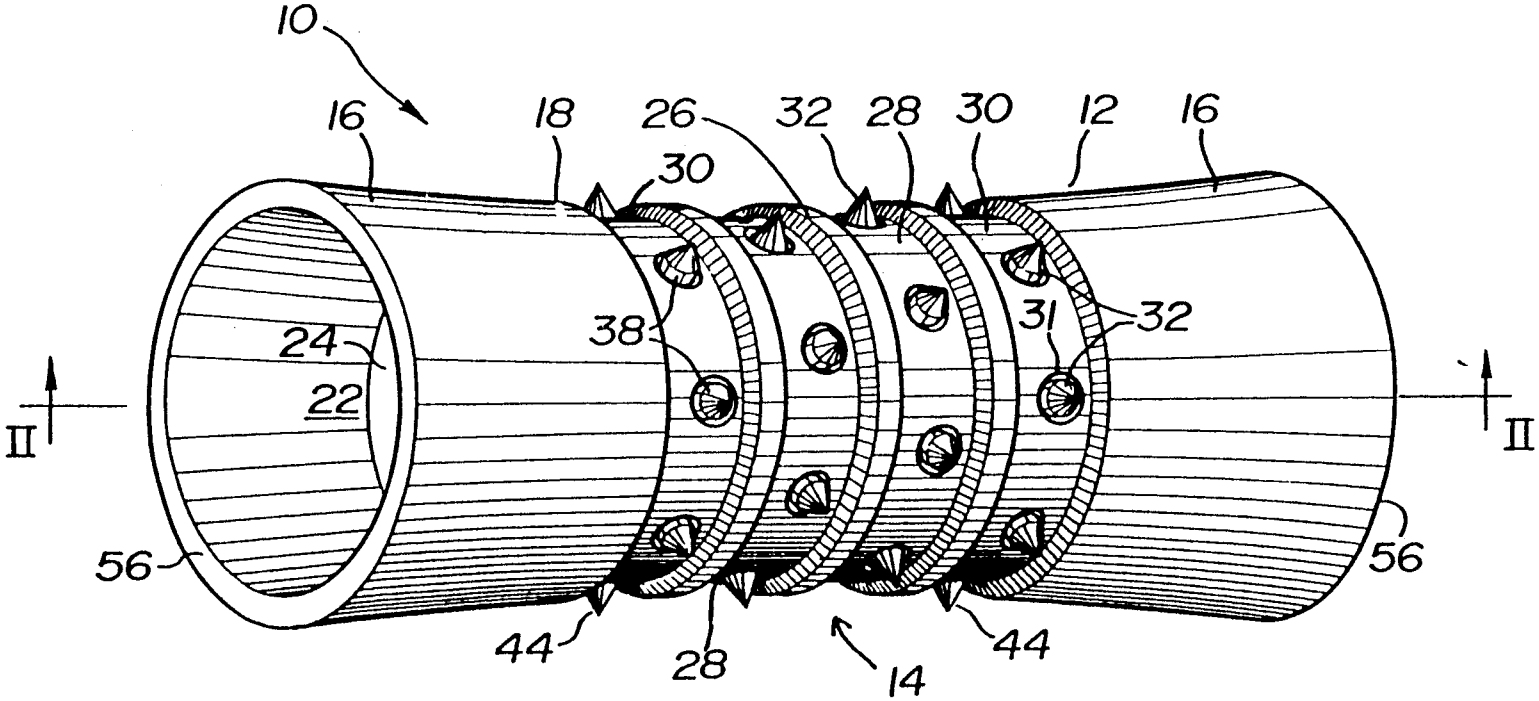
FIG. 1 is a perspective of an embodiment of a pig according to the invention.
Figure 2:
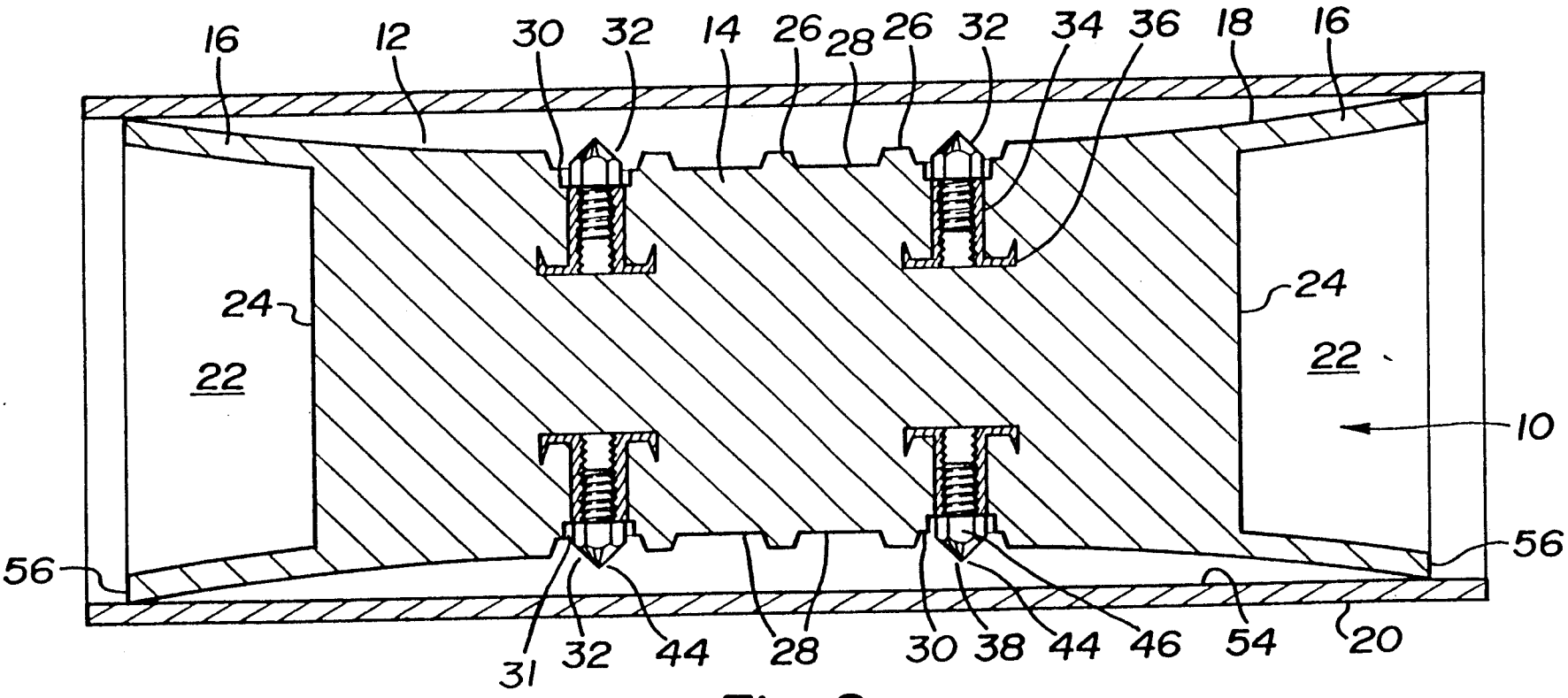
FIG. 2 is a longitudinal section through the pig of FIG. 1.

Referring to FIGS. 1 and 2 there is shown a pig constructed from a generally cylindrical body 10 made of an elastic material, preferably by moulding. The pig is shown in a pipeline 20 in FIG. 2. The cylindrical body 10 has a first end 12 and second end 18, with central portion 14 of reduced radius. The body includes a plurality of ribs 26, and central annular recessed sections 28 and outer annular recessed sections 30 on either side of the central recessed sections. As described in my co-pending application Ser. No. 07/674,386, the recesses may be interrupted and the annular ribs reinforced by longitudinal ribs, and it will be appreciated that the term recess includes such a configuration.

The reduction of the radius of the body 10 at the central portion 14 results in the central rib having a smaller radius than either of the outer ribs on either side of the central rib, and these outer ribs in turn have a smaller radius than the adjacent ends 12 and 18. Likewise, the two central recesses 28 have a reduced radius by comparison with the two outer recesses 30. In the preferred embodiment shown of a pig for a 10 cm pipeline, the reduction of the radius of the central rib by comparison with the radii of the two ends 12 and 18 is about 0.5 cm. The pig outer diameter (at the flared ends) will be preferably about 104 mm for a 10 cm pipeline.

Each end 12 and 18 of the body 10 forms a flared and hollow section 16 defining a cavity 22. The radius of the flared ends increases the further away from the central portion of the body to a maximum at the ends 56 of the flared sections 16. As seen clearly in FIG. 2, the reduction of the radius of the body is preferably greatest at the center of the body (at the central rib) and the cylindrical body has gradually increasing radius with increasing distance from the center of the body.

Figure 3:
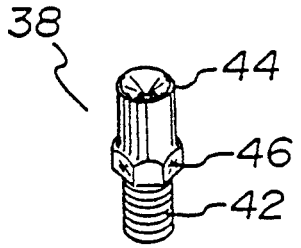
FIG. 3 is perspective of an embodiment of an appendage for use with the pig of FIG. 1.
Figure 4:
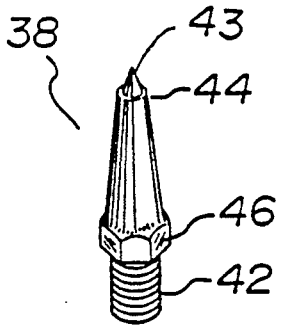
FIG. 4 is a perspective of a further embodiment of an appendage for use with the pig of FIG. 1.
Figure 5:
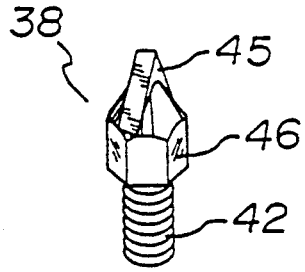
FIG. 5 is a perspective of a further embodiment of an appendage for use with the pig of FIG. 1.
Figure 6:
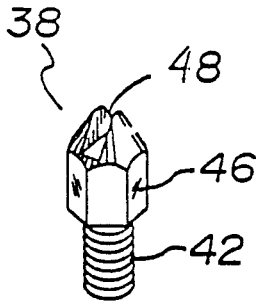
FIG. 6 is a perspective of the embodiment of an appendage of FIG. 5 showing its manner of construction.
Figure 7:
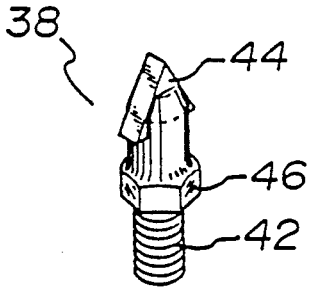
FIG. 7 is a further embodiment of an appendage for use with the pig of FIG. 1.

A plurality of appendages 38 are disposed about and extend radially outward from the cylindrical body 10. Each appendage 38 comprises a head portion 44 and a threaded shank portion 42, preferably integral with each other. The head portion 44 includes a nut shaped portion 46 for engagement by a wrench. Several embodiments of appendages 38 are shown in FIGS. 3-7. The appendage 38 shown in FIG. 3 is made of relatively soft steel, which may or may not be heat treated, and is tubular with an indented end. It is wide for scraping soft coatings. The top may additionally be divided into quarters with slots dividing the quarters and the resulting quarters splayed to the outside for added scraping. The appendage shown in FIG. 4 has a head portion formed by inserting a tip portion or carbide rod 43 into the head portion 44. The carbide tip 43 has a hardness greater than the hardness of the material that forms the head portion 44 and is pointed for scraping soft scale. FIGS. 5 and 6 show an appendage 38 formed from mild steel with a tip portion formed by a tungsten wedge 45 inserted in a slot 48 in the head portion 44 and secured in the slot by soldering. The tungsten wedge provides the hardest tip for scraping the hardest scale such as iron sulphide. FIG. 7 shows an appendage 38 similar to the appendage shown in FIGS. 5 and 6 except it is completely made of tool steel and the length of the appendage is greater. The inventor has found that the appendages of FIGS. 5, 6 and 7 have the most frequent use. Not shown is an appendage made of an L9 bolt, readily commercially available. This is simply a bolt with a threaded shank and hexagonal head.

Figure 8:
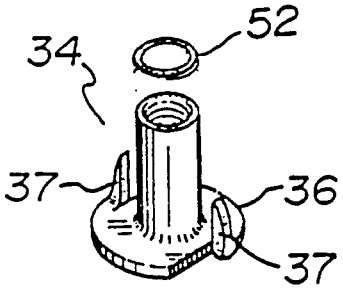
FIG. 8 is a further embodiment of an appendage for use with the pig of FIG. 1.

Each appendage 38 is secured in the body 10 by being threaded into a first end of a threaded sleeve 34 that is itself secured to the body 10. The nut portion 46 allows the appendage to be readily grasped, rotated and removed from the threaded sleeve 34. As shown in FIG. 8, the sleeves 34 have laterally extending flanges 36 at their bases, the flanges 36 also preferably including points 37 extending outward from the flanges parallel to the sleeves towards the first ends of the sleeves (radially outward in the body). The flanges 36 and points 37 secure the sleeves 34 in the body and help prevent the sleeves from being removed from the body, and from being forced deeper into the body. Each appendage 38 with sleeve 34 is secured in one of the recesses 28 or 30 thus forming a plurality of rows of appendages, each row being disposed in a recess. The sleeve is sunk into the body 10 to create a depression 31 about each appendage. The depressions 31 allow the addition of washers 52, for example as shown in FIG. 8, to extend the appendages radially outward as they wear.

Figure 9:
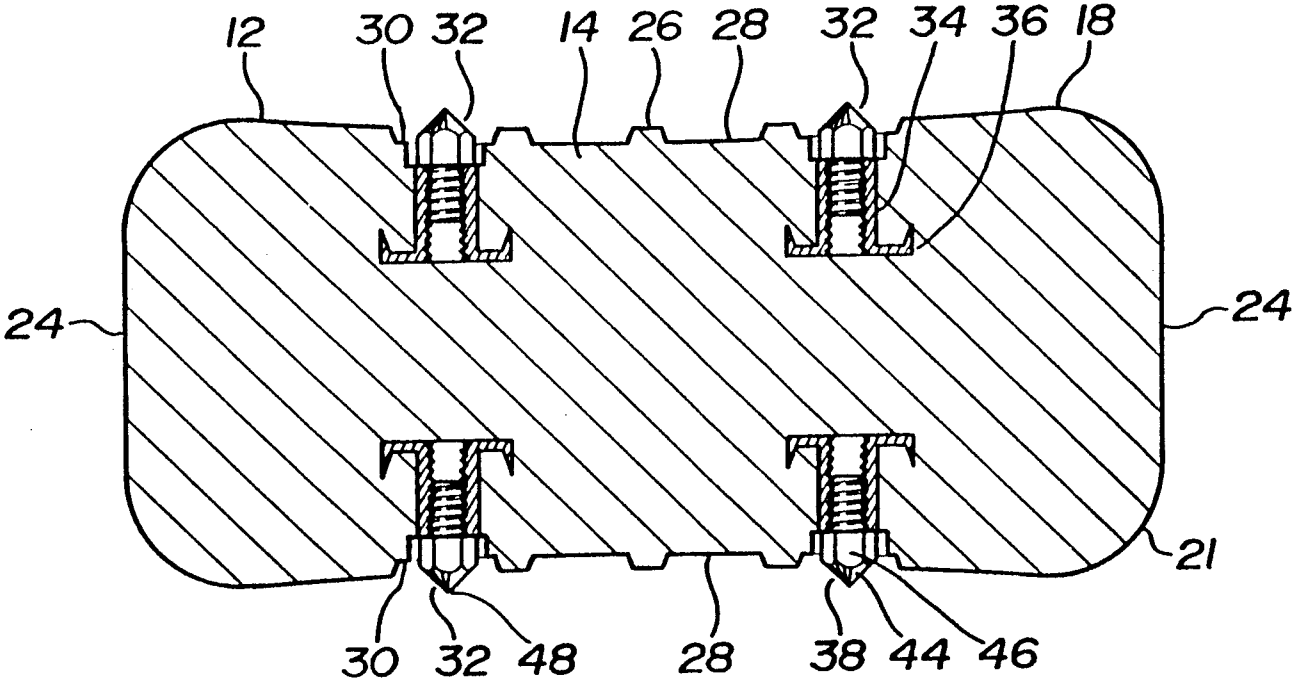
FIG. 9 is a section through another embodiment of a pig, showing a pig with rounded ends.

The rows of appendages 38 in either of recesses 28 will extend radially outward less than the rows of appendages 38 in recesses 30 due to the reduced radius of the body in the central portion 14. As shown, the central two rows of appendages in recesses 28 extend radially outward less than the outer two rows of appendages 38 in recesses 30. Preferably, there will be at least a central row of appendages having reduced radius with a row of appendages of greater radius on either side of the central row. As shown, preferably there will be two central rows of appendages of reduced radius. Only the outer rows of appendages are shown in FIGS. 2 and 9 because the section happens to pass only through those appendages. However, it will be appreciated that the appendages of the inner rows (in recess 28) are attached to the body in a similar manner, and would be shown in like manner, but a different recess, if the section were to pass through one of the appendages in the central rows.

Referring to FIG. 9, there is shown another embodiment of a pig. The pig of FIG. 9 is the same as the pig of FIGS. 1 and 2 except the flared ends have been removed and the leading edges of the pig have been rounded as shown at 21 so that the pig does not get stuck on defects and sharp corners in a pipeline. The shape of the ends 12 and 18 of the pig may be any of various shapes such as conical or hemispherical.

The manner of operation of the pig is as follows. The pig is placed in a pipeline 20, without any appendages, and the pig is run through the pipeline to determine if there are any major obstructions such as a weld extending into the pipeline on which the pig might become stuck. The pig is moved by hydraulic pressure using equipment and techniques that are well known in the art. If there are no obstructions, then a pig is selected that fits in the pipeline with the flared ends 56 of the pig contacting the inner surface 54 of the pipeline 20. The greater the anticipated scale in the pipeline, the smaller the pig to be selected, and generally the longer the appendages to be selected. With thin layers of scale, the pig body may be selected to fit tightly in the pipeline with the appendages and the ribs compressed against the interior surface of the pipeline. As shown in FIGS. 1 and 2 the pig is selected for soft or medium scale.

A set of appendages 38 is selected for the pig that fit snugly in the pipeline, with a tip hardness and sharpness selected for the anticipated scale. The pig is run through the pipeline, backwards and forwards, through any coated sections. Each time the pig is run through a part of the pipeline is called a pass. It may require several hundred passes to clear the coating in a bad section of the pipeline. The pig may be run through 1000 meters of pipeline, while the coated section may only be 200 meters long. Since the pig is made from an elastic material, it may pass around bends of 180° with a small radius.

In the case of use of the pig shown in FIGS. 1 and 2, hydraulic pressure on the flared ends 16 forces the flared ends 16 radially outward into contact with the inner surface of the pipeline forming a seal between the flared ends 16 and the pipeline 20. When a coated section is encountered, the outer rows of appendages in the recesses 30 will engage the coating, compress further and begin scraping the coating. The appendages will be compressed by the coating in the pipeline, thus placing pressure on the coating, and the appendages will tend to tilt rearward.

In the case of both of the embodiments of pig shown, as the outer rows of appendages engage the coating, hydraulic pressure builds up on the end faces 24 of the cylindrical body 10 and compresses the body and expands the central portion 14. The radial expansion of the central portion 14 forces the row of appendages 38 in the inner recesses 28 outward, where they may also engage and compress against the unwanted coating on the inner surface of the pipeline and scrape a portion of the coating off. After numerous passes through the coated section of the pipeline, the appendages will wear and washers (such as washer 52 shown in FIG. 8) may be placed between the nut sections 46 of the appendages 38 and the sleeves 34 to move the pins radially outward. The pig may be then run through the pipeline again, scraping further layers of the coating off. With repeated passes of the pig through the coated section, with succeeding passes using appendages extending further radially outward, successive fine layers of the coating may be removed until the pipeline is substantially free of coating.

After a number of passes the appendages 38 will become excessively worn and will need replacing. By reducing the diameter of the central section of the body of the pig, the appendages in the inner recesses 28 will be less worn and will last longer. The appendages may also be rotated between rows as different appendages become worn. The inside of the pipeline will also be less worn.

The flared ends 16 of the pig shown in FIGS. 1 and 2 are most useful in situations when it is desirable to prevent by-pass of fluids around the pig. This might occur when it is desirable to know the exact location of the pig, since the amount of fluid being pumped may then be used to determine the location of the pig accurately. For some applications, such as when there is a large amount of scale in the pipeline, it may be desirable to eliminate the flared ends and allow larger amounts of by-pass. For example, with thick soft coating, the pig shown in FIG. 9 with long appendages may be selected. This will result in a larger clearance between the body 10 and the interior surface of the pipeline. Fluid, usually water, being used to propel the pig, will then by-pass the pig and carry the soft coating in a slurry along and out of the pipeline.

The ribs 26 may be varied in size and hardness depending on the desired sealing capabilities of the pig. For example, the ribs 26 nearer to the ends 12 and 18 may be harder since they need to withstand greater forces than the central rib.

The pig is made by placing the sleeves 34 in a mould in the desired position, the mould having the preferred shape of the body, and by filling the mould with known techniques with a suitable elastic material for building pigs. Such suitable materials include plastic, polyethylene, polypropylene, rubber, urethane and foam. Once the elastic material cures, the sleeves will be secured within the body of the pig.

Other methods of detachably attaching the appendages to the sleeves and thence to the pig body could be used. Thus the appendages could use a twist lock method, in which the appendage includes a key that slides in a slot in the sleeve and may be rotated into a recess in the slot to secure the appendage in the sleeve. Or the appendages could be simply wedged in or snapped in. However, the use of threads facilitates the use of washers to extend the pins further outward as the pins wear and is preferred.

The pig is preferably designed symmetrically to allow the pig to change direction at any time. The pig of FIGS. 1 and 2 may also be used to separate products in a pipeline by providing a movable seal between them.

ALTERNATIVE EMBODIMENTS

A person skilled in the art could make immaterial modifications to the invention described and claimed in this patent without departing from the essence of the invention.

I claim:

1. A pipeline pig comprising:

a generally cylindrical body made of elastic material and having first and second ends and a central portion;

a plurality of appendages disposed about and extending radially outward from the central portion of the body;

the central portion of the body having a portion with reduced radius, and a portion not having reduced radius, appendages being disposed about and extending radially from both portions, such that appendages in the portion with reduced radius extend radially outward less than appendages in the portion of the body not having reduced radius.

2. The pipeline pig of claim 1 in which the first and second ends of the cylindrical body are flared and hollow, such that the radius of the flared ends is greater the further away from the central portion of the body.

3. The pipeline pig of claim 1 in which the appendages are detachably secured to the body.

4. The pipeline pig of claim 3 further including threaded sleeves secured to the body and in which the appendages are secured to the body by being threaded into the threaded sleeves.

5. The pipeline pig of claim 4 further including washers disposed between the sleeves and the appendages.

6. The pipeline pig of claim 5 in which the appendages are secured in recesses in the body.

7. A pipeline pig comprising:

a generally cylindrical body made of elastic material and having first and second ends and a central portion;

a plurality of appendages disposed about and extending radially outward from the body; and means to extend the appendages radially outward to different heights in relation to the body.

8. The pipeline pig of claim 7 in which the means to extend the appendages radially outward in relation to the body includes threaded sleeves secured to the body and in which the appendages are secured to the body by being threaded into the threaded sleeves.

9. The pipeline pig of claim 8 in which the means to extend the appendages radially outward in relation to the body further includes washers disposed between the sleeves and the appendages.

10. The pipeline pig of claim 9 in which the appendages are detachably secured to the body.

11. The pipeline pig of claim 7 in which the appendages are secured in recesses in the body.

12. The pipeline pig of claim 7 in which the first and second ends of the cylindrical body are flare and hollow, such that the radius of the flared ends in greater the further away from the central portion of the body.

13. The pipeline pi of claim 7 in which the central portion of the body has a portion with reduced radius, and a portion without reduced radius, a first set of appendages being disposed about the portion with reduced radius and a second set of appendages being disposed about the portion without reduced radius, such that the first set of appendages extends radially outward less than the second set of appendages.

14. A detachable appendage assembly in combination with a cylindrical pipeline pig having a central portion, the detachable appendage being attached to the central portion of the pipeline pig, for use in scraping scale from the inside of pipelines, the detachable appendage assembly comprising:

a detachable appendage having a shank portion and a head portion;

a sleeve secured in the central portion of the pig and having means to prevent the sleeve from being removed from the body of the pipeline pig, the sleeve being oriented radially in relation to the pipeline pig; and the detachable appendage and the sleeve each having means cooperating with each other to detachably secure the detachable appendage within the sleeve.

15. The detachable appendage assembly of claim 14 in which the means cooperating with each other to detachably secure the detachable appendage within the sleeve comprises the sleeve having interior threads and the shank portion having exterior threads.

16. The detachable appendage assembly of claim 14 in which the means to prevent the sleeve from being removed from the body of the pipeline pig includes a laterally extending flange.

17. The detachable appendage assembly of claim 16 further including a point extending outward from the flange parallel to the sleeve.

18. The detachable appendage assembly of claim 14 further including a washer disposed between the head portion of the detachable appendage and the sleeve.

19. The detachable appendage assembly of claim 14 in which the sleeve has a first end for receiving the shank portion of the detachable appendage and a second end opposed to the first end, the means to prevent the sleeve from being removed from the body of the pipeline pig being attached to the second end and including a laterally extending flange.

* * * * *